United States Patent [19]

Cantley

[11] 4,439,758

[45] Mar. 27, 1984

[54] COMBINATION DOOR LOCK AND ALARM

[76] Inventor: Richard E. Cantley, 1469 Shelley St., NE., North Canton, Ohio 44721

[21] Appl. No.: 317,457

[22] Filed: Nov. 2, 1981

[51] Int. Cl.[3] ..... G08B 13/08

[52] U.S. Cl. ..... 340/546; 70/DIG. 49; 70/DIG. 68; 292/288

[58] Field of Search ..... 340/545, 546; 70/DIG. 49, DIG. 68

[56] References Cited

U.S. PATENT DOCUMENTS

| | | | |
|---|---|---|---|
| 723,478 | 3/1903 | Mills | 340/546 |
| 1,144,576 | 6/1915 | Wilson | 70/DIG. 68 |
| 1,377,939 | 5/1921 | Sundel . | |
| 2,555,611 | 6/1951 | Smith | 292/288 |
| 2,824,300 | 2/1958 | Rand | 340/545 |
| 2,988,787 | 6/1961 | Migneault et al. | 20/52 |
| 3,773,369 | 11/1973 | Wersonick | 292/150 |
| 3,798,627 | 3/1974 | Kaufman | 340/546 |
| 4,161,333 | 7/1979 | Guttman | 292/288 |
| 4,176,347 | 11/1979 | McIntyre | 340/545 |
| 4,235,464 | 11/1980 | Cantley | 292/288 |

*Primary Examiner*—David L. Trafton
*Attorney, Agent, or Firm*—Oldham, Oldham, Hudak, Weber & Sand Co.

[57] ABSTRACT

A portable security device adapted to be removably mounted on a door frame adjacent the inside of an inwardly swinging door to prevent the opening of the door and actuate an alarm when forcible entry is attempted. A steel rod is embedded within a rigid housing and extends outwardly from an end wall of the housing. The rod is removably inserted into a complementary-shaped hole in the door frame. The housing has an angled wall extending downwardly toward the rod and forms an exterior angle of between 120° and 165° therebetween. The angled wall lies in abutting relationship with the inside surface of the door blocking the opening of the door. A battery-operated alarm is contained within the housing and has a control button that projects outwardly through a hole in the angled wall and engages the door for actuating an alarm switch. The angled wall may be covered with a sheet of resilient material with the switch button extending a short distance beyond the outer surface of the resilient sheet. The button is depressed to the level of the resilient sheet when the device is placed in position on the door frame. Inward movement of the door will compress the sheet and depress the button to actuate the alarm. The alarm will remain energized even if the door is re-closed since the button is prevented by the door from completely moving outwardly to deactuate the alarm.

15 Claims, 9 Drawing Figures

COMBINATION DOOR LOCK AND ALARM

BACKGROUND OF THE INVENTION

1. Field of the Invention

The invention relates to protective devices for doorways and in particular to a device adapted to be manually installed on the inside of the protected door to prevent unauthorized opening of the protected door, and to actuate an alarm when an unauthorized opening of the door is attempted.

2. Description of the Prior Art

Numerous styles and types of door locks have been constructed using rigid locking bars or bolts to provide extra security at night for residents of a dwelling. Most of these known lock constructions are permanently mounted on the door and door frame, which imparts a cluttered, unsightly appearance to the door since such a device is usually in addition to the existing door lock.

In most of these known locking devices which use retaining bars or bolts, the bolt extends horizontally between the door and frame across the swinging edge of the door. Due to the limited material thickness of the door and door frame, such devices can be broken out if sufficient force is applied to the door. Also, these prior devices are difficult to install in that they require internal drilling of the door as well as of the frame, such as for the usual "dead-bolt" type of lock construction. Also, such dead-bolt mechanism and associated latch plate must be bolted or screwed on both the door and frame.

It is desirable that some type of locking device be provided which is not a permanent part of the door or frame and which can be easily installed by the user when extra protection is required. Also, such device should be extremely difficult to forcibly break away from the door and door frame and one which will not present an unsightly appearance when not in use. Also, such a lock device should be of a relatively inexpensive construction, and one which can be installed with a minimum of labor and expense.

Many of these problems have been eliminated by my prior door lock construction shown and described in U.S. Pat. No. 4,235,464. Although my prior door lock eliminates many of these problems, it is desirable that, in addition to physically preventing entry through the door, some type of an alarm be provided to further deter forcible entry and also to indicate to the occupants that an intruder is attempting to open the protected door.

Numerous alarm devices have been devised and constructed over the years for mounting on a door or adjacent thereto for sounding an alarm when the door is opened to protect the occupants of a dwelling. Examples of such prior art alarms are shown in U.S. Pat. Nos. 1,099,777, 1,377,939, 2,824,300, 3,121,864, 3,261,010, 3,270,333, 3,378,830, 3,768,086, 3,798,627, 3,878,539, and 4,059,832. Many of these prior devices appear to provide a satisfactory alarm and are suitable for their intended purpose. However, such prior alarms only give an audible signal that the door is being opened and do not provide any means of physically impeding the opening of the door. Also, many of these prior alarms do not remain activated if the door is immediately closed by an intruder once the alarm is initially sounded.

Therefore, it is desirable that some type of security device be provided that is not a permanent part of the door or frame, which can be easily installed by the user when extra protection is required, which is extremely difficult to forcibly break away from the door and door frame, which will not present an unsightly appearance when not in use, which is of a relatively inexpensive construction, and which can be installed with a minimum of labor and expense, and which provides an alarm when the protected door is attempted to be opened, which alarm will not deenergize if the intruder immediately recloses the door. My improved combination door lock and alarm, which is described below and shown in the drawings, is believed to satisfy these requirements and provide these advantages.

SUMMARY OF THE INVENTION

Objectives of the invention include providing an improved door lock and alarm construction which is not permanently attached to the door or frame so that it does not present an unsightly appearance when not in use, and which when installed provides an extremely strong device which would require a considerable amount of force to overcome its retaining effort, and which also will sound an audible alarm when the door is attempted to be opened, which alarm will not cease if the intruder immediately closes the door. Another objective is to provide such a device which requires only a single hole to be drilled in the door frame for its use, which hole cannot be readily seen by occupants of the dwelling or by visitors thereto, and which requires no holes or attachment means on the door. Another objective is to provide such a device which is of an extremely rugged, simple and inexpensive construction, which includes one or more retaining pins or rods that extend into and engage the door framing studs to provide increased strength than that provided by prior locking bolts or pins which engage only a portion of a single door frame stud or molding trim, which can be disengaged easily and quickly by a single manipulative step, thereby enabling an occupant to unlock the door quickly in case of fire or other emergency yet which cannot be easily dislodged by an intruder, and in which the alarm is automatically moved to the correct actuating position upon installation.

Another objective is to provide such a device which consists of a compact, rigid housing preferably formed of molded plastic, having an extremely simple and inexpensive audible alarm mounted within cavities formed within the housing and having a single steel locking rod embedded in the housing and extending outwardly from one end thereof for insertion into a complementary-shaped and sized hole formed in the door frame. Still another objective is to provide such a security device having a flat planar surface covered by a thin sheet of resilient material which lies in abutting relationship with the inside surface of the door to prevent marring of the door surface. Another objective is to provide such a device in which an alarm-actuating button extends a short distance through and beyond the resilient sheet of material, and in which the button is partially depressed upon the device being placed in position to arm the alarm whereby any opening movement of the door will further depress the actuating button to sound the alarm, yet the partially depressed button is prevented by the door from moving outwardly the required extent for deactuating the alarm, thereby preventing the intruder from deactuating the alarm upon closing of the door. Another objective is to provide such an improved device which will not mar the finish or frame of the door, which can be repaired extremely easily should it become damaged, which is relatively free of moving parts that are subject to breakage, in which the alarm is formed of inexpensive components consisting of an audible signaling buzzer operated by a standard 6-volt or 9-volt battery located within the housing. A still further object is to provide such a combination door lock and alarm which eliminates difficulties heretofore encountered, which achieves the stated objectives effectively, efficiently and inexpensively, and which solves problems and satisfies needs in the art.

These objectives and advantages are obtained by the improved security device which is adapted to be mounted on a door frame adjacent the inside of an inwardly swinging door, and in which a hole has been formed in said frame, the general nature of said security device may be stated as including a housing having a surface adapted to be positioned closely adjacent the inside surface of the door to limit inward movement of the door when the device is mounted on the door frame; a rigid rod mounted on the housing and projecting outwardly therefrom, said rod being adapted to be inserted into the door frame hole to mount the security device on the door frame; and an alarm mounted within the housing having an actuator projecting outwardly beyond said surfce of the housing and engageable with the inside door surface when the security device is mounted on the door frame with said actuator being movable between alarm ON and OFF positions, whereupon the said housing surface will abuttingly engage the inside surface of the door to limit inward movement of the door and in which inward movement of the door will move the actuator to the alarm ON position to actuate said alarm.

BRIEF DESCRIPTION OF THE DRAWINGS

The preferred embodiment of the invention, illustrative of the best mode in which applicant has contemplated applying the principles, is set forth in the following description and shown in the drawings, and is particularly and distinctly pointed out and set forth in the appended claims.

Similar numerals refer to similar parts throughout the drawings.

DESCRIPTION OF THE PREFERRED EMBODIMENT

Figure 2:
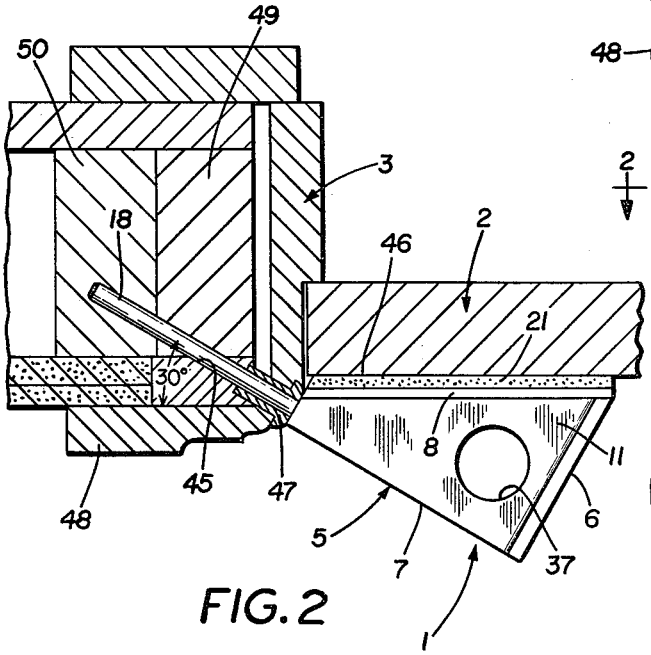
FIG. 2 is a sectional view taken on line 2—2, FIG. 1.
Figure 1:
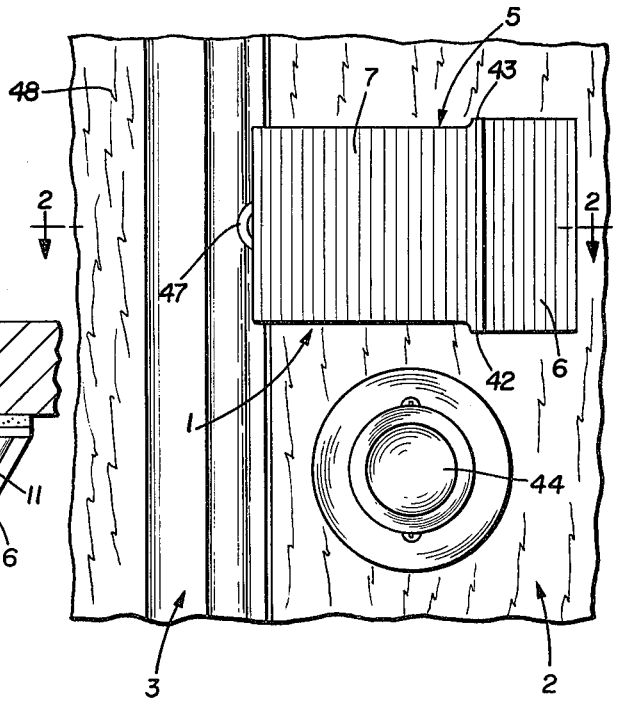
FIG. 1 is a fragmentary front view of the inside of a door adjacent frame having the improved combination door lock and alarm mounted thereon.
Figure 3:
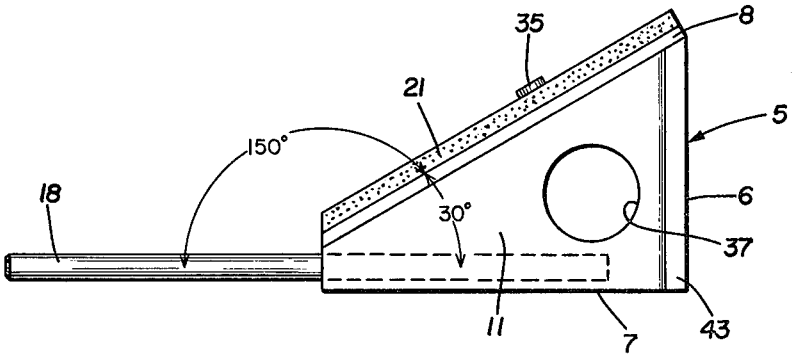
FIG. 3 is an enlarged side elevational view of the improved combination door lock and alarm construction removed from the door of FIGS. 1 and 2.
Figure 5:
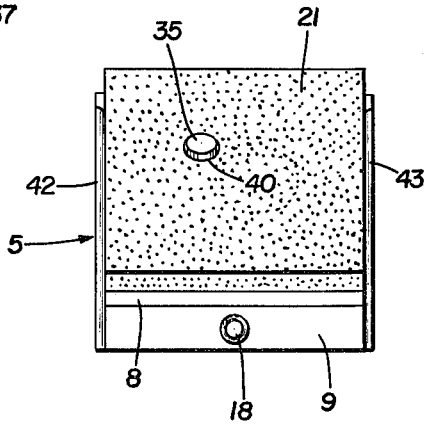
FIG. 5 is a left-hand end elevational view of the combination door lock and alarm construction shown in FIGS. 3 and 4.
Figure 4:
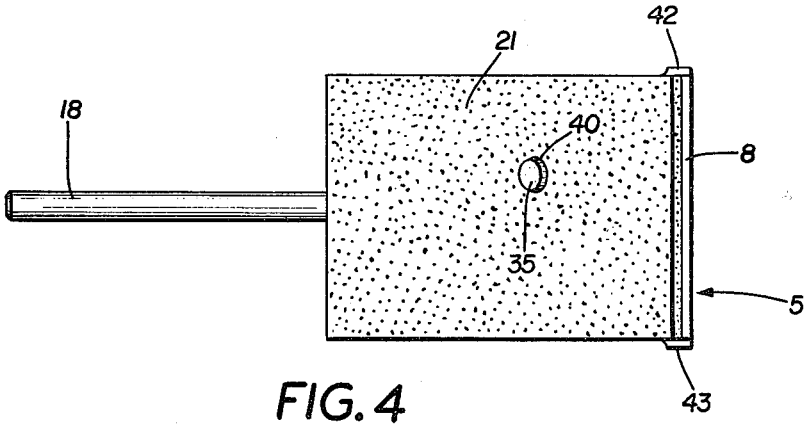
FIG. 4 is a top plan view of the door lock and alarm construction shown in FIG. 3.

The improved combination door lock and alarm construction, which forms the security device of the invention, is indicated generally at 1, and is shown mounted on and operatively engaged with a door 2 and a door frame 3 in FIGS. 1 and 2. Improved security device 1 includes a housing, indicated generally at 5, formed of a rigid material, preferably molded of a durable, rigid, high-strength plastic material.

Figure 6:
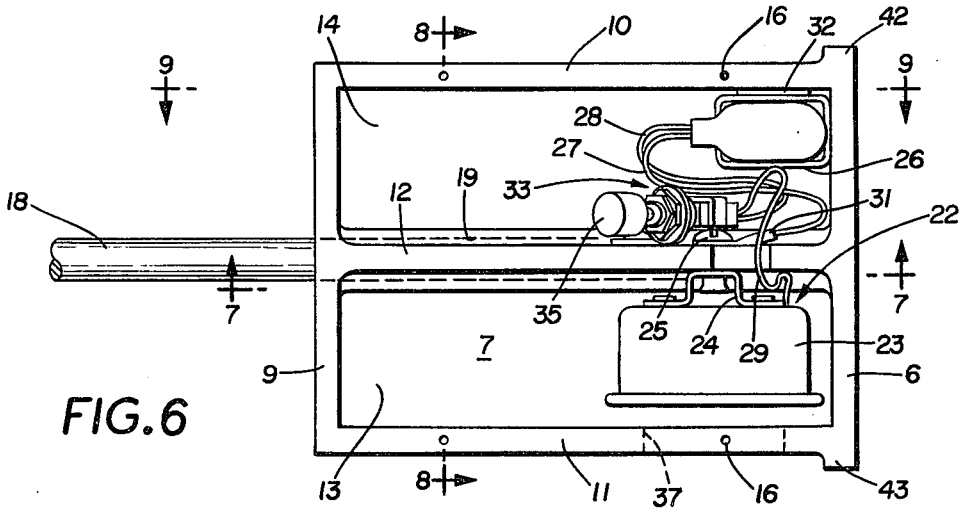
FIG. 6 is an enlarged fragmentary top plan view similar to FIG. 4 with the top cover removed.
Figure 7:
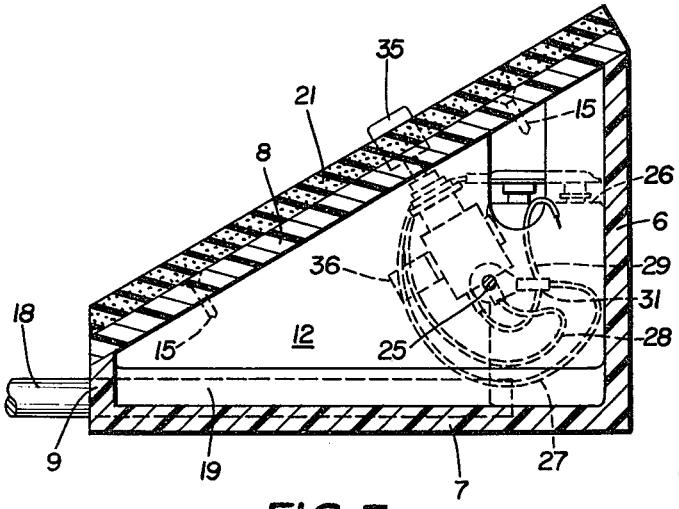
FIG. 7 is a sectional view taken on line 7—7, FIG. 6.
Figure 9:
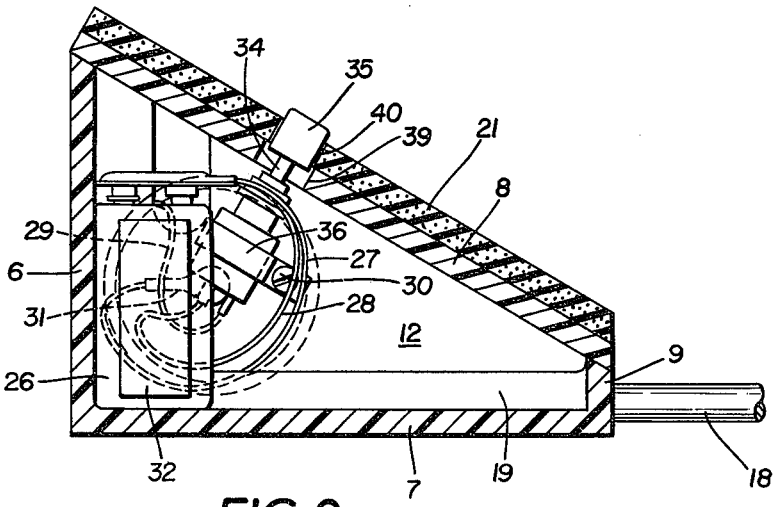
FIG. 9 is a sectional view taken on line 9—9, FIG. 6.

Housing 5 has a generally truncated configuration with a rear wall 6 that forms a right angle with a bottom wall 7, as shown in FIGS. 7 and 9. A door-retaining planar top wall or housing cover 8 extends downwardly forwardly from rear wall 6 at an included angle of approximately 30° therewith, and terminates at a front wall 9. Front wall 9 preferably is parallel with front wall 6 and forms a right angle with bottom wall 7. A pair of spaced, generally triangular-shaped parallel side walls 10 and 11 (FIG. 6) complete the configuration of housing 5. Housing rear wall 6, bottom wall 7, front wall 9, and side walls 10 and 11 preferably are integrally molded as a one-piece plastic member and include an internal, centrally located reinforcing wall 12 which has a generally triangular configuration and extends between rear wall 6 and front wall 9. The housing walls and reinforcing wall 12 form a pair of interior chambers 13 and 14.

Figure 8:
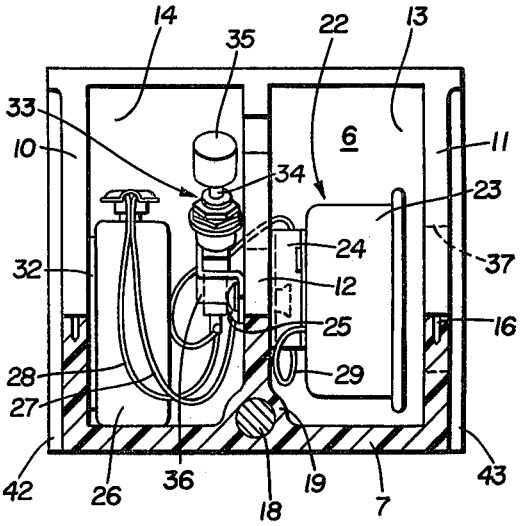
FIG. 8 is a sectional view taken on line 8—8, FIG. 6.

Angled wall 8 is removably mounted on the housing walls by a plurality of screws 15 or other fastening means which extend through the edges of angled wall 8 into holes 16 formed in the top edges of side walls 10 and 11 (FIGS. 6 and 7). A rigid metal rod 18 is embedded in an enlarged area 19 formed at the junction of reinforcing wall 12 and bottom wall 7 (FIG. 8) and projects outwardly a predetermined distance from end wall 9. Rod 18 preferably is formed of a high-strength alloy steel and has a diameter of between $\frac{3}{8}$ and $\frac{1}{2}$ inch and is embedded in enlarged area 19 and extends generally throughout the length of the housing to provide a rigid and firm mounting of the rod with respect to housing 5. Rod 18 forms an exterior angle of approximately 150° with the top surface of housing wall 8, as shown in FIGS. 7 and 9. This angle can vary generally within the range of from 120° to 165° without affecting the operation of improved lock and alarm construction 1.

In accordance with one of the features of the invention, a resilient sheet of material 21, such as sponge rubber, is mounted on the top surface of housing wall 8. The purpose of sheet 21 is described in greater detail below. An audible alarm, indicated generally at 22, is mounted in housing chambers 13 and 14. Alarm 22 consists of a usual audible sound-producing buzzer 23 which is mounted within chamber 13 on housing reinforcing wall 12 by a bracket 24 and a bolt 25. Buzzer 23 is operated by a standard 6-volt or 9-volt battery 26 which is connected to buzzer 23 by wires 27, 28 and 29. Battery 26 preferably is mounted within housing chamber 14 on the inside surface of side wall 10 by a strip of pressure-sensitive adhesive 32 or other fastening means. One terminal of battery 26 is grounded to the casing of buzzer 23 by wire 27 which is clamped beneath the head of bolt 25 by a terminal clip 31. A hole 37 is formed in housing side wall 11 opposite buzzer 23 so that the sound produced by buzzer 23 will escape easily from within the housing interior.

An alarm actuator switch, indicated generally at 33, is connected in the alarm circuitry between buzzer 23 and battery 26 by wires 28 and 29. Switch 33 is a usual type of ON-OFF switch having a depressible plunger 34 and an actuating button 35. Switch 33 preferably is mounted within housing chamber 14 by a bracket 36 which is mounted on reinforcing wall 12 by a mounting screw 30. Switch 33 is mounted on wall 12 at an angle so that plunge 34 and button 35 will extend outwardly through complementary-shaped holes 39 and 40 formed in housing wall 8 and resilient sheet 21, respectively (FIG. 9), whereupon the axis of plunger 34 is generally perpendicular to the plane of wall 8 and sheet 21. In accordance with one of the features of the invention, button 35 will extend above the surface of sheet 21 a predetermined distance approximately ⅛ inch, the purpose of which is described more fully below.

A pair of ribs 42 and 43 are formed along the edges of rear wall 6 adjacent side walls 10 and 11, respectively. Ribs 42 and 43 provide projections which are gripped easily by a user when installing and removing security device 1 from a door and door frame. Handle means other than ribs 42 and 43 could be provided on housing 5, if desired.

The manner of use and installation of security device 1 is shown diagrammatically in FIGS. 1 and 2. The preferred location of device 1 is just above the door handle or knob 44. An angled hole 45 is drilled through the corner of door frame 3 adjacent the edge of the door frame at an angle complementary to the included angle of intersection between door surface 46 and rod 18, which is approximately 30° in the preferred form of the invention, as shown in FIG. 2. Hole 45 has a diameter complementary to that of rod 18 and will be hardly noticeable in the door frame. A plastic insert sleeve 47 preferably is inserted into the outer end of hole 45 to prevent the raw edges of the hole from being exposed and subjected to chipping or fraying. Insert sleeve 47 can be of a color which matches the color of molding trim 48 making the insert less noticeable. Likewise, housing 5 may be dyed in various colors during the molding procedure to enable the user to match housing 5 to the color of the door and/or frame.

After door 2 has been shut, security device 1 is installed by inserting rod 18 in hole 45 until resilient sheet 21 is in abutting engagement against inside surface 46 of door 2. In this position front wall 9 of housing 5 will usually be abutting the outer end of insert sleeve 47. As can be seen in FIG. 2, the angular relationship of hole 45, which is dependent upon the angular relationship between rod 18 and housing wall 8, enables rod 18 to extend through the outermost stud 49 and partially into inner stud 50 of the door frame casing. This double stud arrangement is a common construction practice of most doorway casings. To achieve such penetration, rod 18 will have an exposed length of approximately 4 inches.

In accordance with one of the features of the invention, housing 5 is positioned with rod 18 in opening 45 until resilient sheet 21 is pressed against door surface 46, which will depress alarm button 35 and plunger 34 approximately ⅛ inch toward the alarm ON position. Switch 33 is of a usual construction wherein plunger 34 must be depressed approximately ¼ inch to trip the switch to the OFF position and must return the full ¼ inch to its undepressed position to trip the switch to the ON position.

As can be seen from FIG. 2, in order to open door 2 a large force would have to be exerted inwardly on the door to completely move housing 5 in a pivotal direction, requiring rod 18 to rip completely through portions of studs 49 and 50, molding trim 48 and any facing board which may be interposed therebetween. Thus, device 1 provides an effective restraint against any physical force exerted against the door. However, immediately upon inward movement of door 2, sheet 21 will be compressed enabling button 35 and plunger 34 to be depressed an additional ⅛ inch, which will move switch 33 to the ON position and actuate alarm buzzer 23 sounding an audible alarm. The alarm will deter most intruders from continuing their attempted entry as well as indicate to the occupants of the dwelling the attempted forced entry.

In accordance with another feature of the invention, even if the intruder immediately closes the door after hearing the alarm, the initial ⅛ inch depression of plunger 34 and button 35 when installed will not permit the button and plunger to move outwardly to its full extent of quarter-inch movement necessary to move switch 33 to its OFF position to deenergize the alarm. Thus, once the alarm is activated by a slight inward movement of door 2, it cannot be deactuated until the lock and alarm construction is pulled outwardly from its mounting on door frame 3.

Accordingly, improved door lock and alarm 1 provides a construction which is extremely simplified and inexpensive consisting of a rigid, preferably plastic molded member having a door-abutting planar surface extending at a predetermined angle with respect to the longitudinal axis of locking rod 18 which is embedded in the housing and projects a predetermined distance outwardly therefrom. Furthermore, only a single hole having a relatively small diameter is required to be drilled in the door frame at a predetermined angle, the exposed end of which may receive a plastic insert sleeve to provide a pleasing appearance. Likewise, no attachments of any type are necessary on the door itself which would leave holes or mar the surface thereof if later removed. Also, resilient sheet 21 which is mounted on the outer surface of angled housing wall 8, in addition to assisting the operation of alarm plunger 34 and button 35, also prevents scratching and marring of the door surface. Another important feature of device 1 is the continuous sounding of alarm buzzer 23 once actuated, even if the intruder immediately closes the door.

If desired, housing 5 may be formed of various materials and have other configurations than that shown in the drawings without affecting the concept of the invention. Also, rod 18 may be replaced by two or more rods, if desired. Thus, device 1 provides a device which in addition to physically retarding or preventing the unauthorized opening of a door also sounds an alarm immediately upon any attempted opening of the door, which alarm will remain actuated until the occupant of the house silences the same. Furthermore, device 1 provides an efficient, rugged and durable construction which is formed of generally readily available materials, which achieves all the enumerated objectives, eliminates difficulties encountered with prior door locking and alarm devices, and solves problems and obtains new results in the art.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved combination door lock and alarm is con-structed and used, the characteristics of the construction, and the advantageous, new and useful results obtained; the new and useful structures, devices, elements, arrangements, parts, and combinations, are set forth in the appended claims.

I claim:

1. An improved security device adapted to be mounted on a door frame adjacent the inside of an inwardly swinging door, and in which a hole has been formed in said frame, said device including:

(a) a housing having a surface adapted to be positioned closely adjacent the inside surface of the door to limit inward movement of the door when the device is mounted on the door frame;

(b) a rigid rod mounted on the housing and projecting outwardly therefrom, said rod being adapted to be inserted into the door frame hole to mount the security device on the door frame; and (c) an alarm mounted within the housing having an actuator projecting outwardly beyond said surface of the housing and engageable with the inside door surface when the security device is mounted on the door frame with said actuator being movable between alarm ON and OFF positions, whereupon the said housing surface will abutting engage the inside surface of the door to limit inward movement of the door and in which inward movement of the door will move the actuator to the alarm ON position to acuate said alarm.

2. The device defined in claim 1 in which said housing surface forms an exterior angle with the axis of the rigid rod in the range of 120° to 165°.

3. The device defined in claim 2 in which the housing has a hollow, generally truncated configuration defined by a pair of spaced parallel side walls, a bottom wall, front and rear walls, and a top wall; and in which said housing surface is formed on the top wall and extends downwardly from the rear wall toward the front wall.

4. The device defined in claim 3 in which an internal reinforcing wall is located within the hollow interior of the housing and extends along the bottom wall between the front and rear walls.

5. The device defined in claim 4 in which the rod is embedded in the reinforcing wall and projects outwardly beyond the front wall a predetermined distance.

6. The device defined in claim 3 in which the housing side, bottom, front and rear walls are formed as an integral one-piece member; and in which the top wall is removably mounted on the one-piece member.

7. The device defined in claim 6 in which the rod is formed of a high-strength alloy steel and the housing is molded of a high-strength plastic material.

8. The device defined in claim 1 in which a sheet of resilient material is mounted on said housing surface; in which the alarm actuator projects outwardly a predetermined distance beyond said surface through aligned holes formed in said surface and resilient sheet; and in which the actuator is depressed toward the alarm ON position when the device is mounted on the door frame.

9. The device defined in claim 1 in which the alarm includes a battery, a sound-producing buzzer operable by said battery, and a switch operable by the actuator for operatively connecting and disconnecting the buzzer to the battery.

10. The device defined in claim 9 in which the housing has a hollow interior; and in which the battery, buzzer and switch are mounted within the hollow interior of the housing.

11. The device defined in claim 1 in which gripping means is formed on the housing for grasping the housing to remove it from an installed position on a door frame.

12. The device defined in claim 1 in which the said housing surface forms an exterior angle with the axis of the rod of approximately 150°.

13. In combination with an inwardly swinging door and adjacent door frame, an improved combination lock and alarm construction including:

(a) a housing having a surface adapted to abuttingly engage the inside surface of the door;

(b) rigid rod means mounted on the housing and projecting outwardly therefrom, said rod forming an exterior angle with the door-engaging surface of the housing in the general range of 120° to 165°;

(c) hole means formed in the door frame, said hole means having a size and configuration complementary to the size and configuration of the rod means for receiving the same, and said hole means projecting inwardly and away from the adjacent door at an angle with respect to the inside door surface, whereby the door-engaging surface of the housing lies in abutting relationship with the door surface when the door is closed and the rod means is inserted into the door frame hole means preventing opening of the door; and (d) alarm means mounted within the housing having an actuator projecting outwardly beyond the door-engaging surface and engageable with the door surface with said actuator being movable between alarm ON and OFF positions, whereupon inward movement of the door will move the actuator to the alarm ON position to actuate said alarm.

14. The construction defined in claim 13 in which a sheet of resilient material is mounted on the door-engaging surface; and in which the alarm actuator projects beyond the resilient sheet and is depressed to the level of said sheet when the rod means is inserted into the door frame hole.

15. The construction defined in claim 14 in which the actuator is prevented by the door from moving from ON to OFF position after being moved to said ON position upon inward movement of the door.

* * * * *